United States Patent [19]

Button

[11] Patent Number: 5,042,072

[45] Date of Patent: Aug. 20, 1991

[54] SELF-COOLED LOUDSPEAKER

[75] Inventor: Douglas J. Button, Los Angeles, Calif.

[73] Assignee: Harman International Industries, Inc., Northridge, Calif.

[21] Appl. No.: 337,826

[22] Filed: Apr. 14, 1989

[51] Int. Cl.[5] ..... H04R 25/00

[52] U.S. Cl. ..... 381/192; 381/199; 381/201

[58] Field of Search ..... 381/192, 194, 199, 200, 381/201, 193

[56] References Cited

U.S. PATENT DOCUMENTS 4,508,941 4/1985 Wiggins ..... 381/199
4,757,547 7/1988 Danley ..... 381/194

FOREIGN PATENT DOCUMENTS 0027600 3/1981 Japan ..... 381/199
0148499 8/1984 Japan ..... 381/165
0140598 6/1987 Japan ..... 381/199

*Primary Examiner*—Jin F. Ng
*Assistant Examiner*—Jason Chan
*Attorney, Agent, or Firm*—Jones, Day, Reavis & Pogue

[57] ABSTRACT

A self-cooled electrodynamic loudspeaker wherein the magnetic structure or pole piece has channels whereby cool air may be introduced and hot air may be exhausted to cool a voice coil by movement of the speaker diaphragm. This self-cooling results in greater power handling and output of the speaker.

15 Claims, 3 Drawing Sheets

SELF-COOLED LOUDSPEAKER

BACKGROUND OF THE INVENTION

Conventional permanent-magnet electrodynamic loudspeakers employ a diaphragm which is vibrated by an electromechanical drive. The drive generally comprises a magnet and a voice coil through which an electrical signal is passed. The interaction between the current passing through the voice coil and the magnetic field produced by the permanent magnet causes the voice coil to oscillate in accordance with the electrical signal, and drive the diaphragm to produce sound.

The coils or windings used are conductive and carry alternating current. In operation, the resistance of the conductive material causes the production of heat in the voice coil or winding. The tolerance of the driver to heat is generally determined by the melting points of the various components and the heat capacity of the adhesive used to construct the voice coil. As the DC resistance of the voice coil comprises a major portion of a driver's impedance, most of the input power is converted into heat rather than sound. Ultimate power handling capacity of a driver hence is strictly limited by the ability of the device to tolerate heat.

The problems produced by heat generation are further compounded by temperature-induced resistance, commonly referred to as power compression. As the temperature of the driver increases, the DC resistance of copper or aluminum conductors or wires used in the driver also increases. For example, a copper wire voice coil that has a resistance of six ohms at room temperature has a resistance of twelve ohms at 270° C. At higher temperatures, power input is converted mostly into additional heat rather than sound, thereby posing a serious limitation on driver efficiency.

It is therefore desirable to cool the voice coil under operation to maximize driver efficiency.

Previously it has been suggested to cool the voice coil by forcing air into the center of the magnet structure and over the coil windings. For example, U.S. Pat. No. 4,757,547 discloses an external blower which forces air over the voice coils to cool them. However, in practice this system has drawbacks. As the gap between the voice coil and the pole piece of the magnet is very small (approximately 0.010 inches) cooling can only be achieved by forcing air through this air gap at a very high air pressure. Under a high air pressure, the dome will take on a positive set and cause the coil to be no longer centered in the gap. This offset will cause second-harmonic distortion. Additionally, the blower can be loud and obviously non-musical, resulting in speaker distortion and excessive noise.

There have also been attempts to use the movement of the dome to force air past the voice coil through movement of the cone with a sealed magnet structure. This system also has its drawbacks in that the air gap between the voice coil and the magnet is too small to allow proper flow past the windings of the voice coil. While a higher power handling may be achieved with this structure, the sound quality is affected due to the air flow through the gap which causes changes in the motion of the dome or cone, resulting in distortion and a damped bass response.

OBJECT AND SUMMARY OF THE INVENTION

The present invention provides a method for self-cooling an electrodynamic loudspeaker wherein at least two passages are provided for in the magnetic structure or pole piece adjacent to the voice coil. Movement of a dome forces air through these passages, cooling the voice coil by allowing air to flow past the windings in several places, without having to be forced through a tight restriction. This air flow quickly cools the voice coil. The high thermal conductivity of the voice coil permits the heat to easily move circumferentially in the coil to be then dissipated by the air flow.

DETAILED DESCRIPTION OF THE PRESENT INVENTION

The present invention is directed to an electrodynamic loudspeaker which is self-cooled without the use of external blowers or other such structures.

Figure 1:
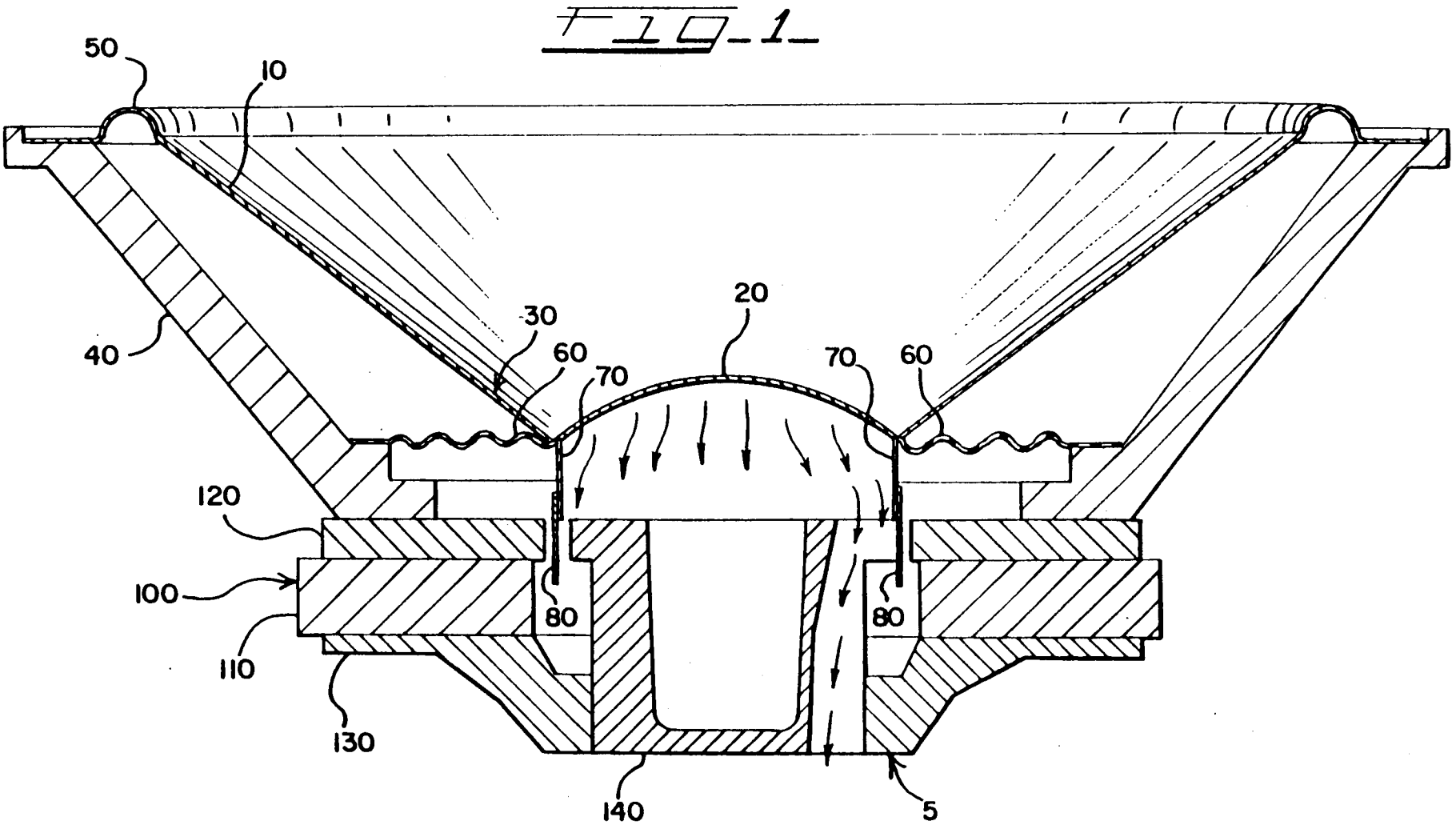
FIG. 1 is a side schematic view of a self-cooled loudspeaker incorporating the features of the invention.

Any conventional electrodynamic loudspeaker may be used, such as that depicted in FIG. 1, which includes the improvements of the present invention. For example, a conventional electrodynamic loudspeaker 5 of the permanent magnet type consists of a cone 10 which is attached through adhesive means to a dome 20, forming a diaphragm 30. The cone 10 and dome 20, which together form diaphragm 30, may be constructed from a stiff but well damped material such as paper. The diaphragm 30 is connected to a speaker frame 40 constructed of a stiff antivibrational material such as aluminum, by means of an upper half roll compliance 50, which may be made from a flexible and fatigue resistant material which may include materials such as a urethane foam, a butyl rubber or a phenolic impregnated cloth. Similarly, on its lower portion, the speaker frame 40 is connected to the intersection of the cone 10 and the dome 10 by a spider 60 which is made from a material similar in properties to the material of the upper half roll compliance. By this connection, the diaphragm 30 is prevented from radial movement and thus is constrained to axial movement.

Also at the point of intersection of the cone 10 and the dome 20 is a former 70 made of high temperature resistant plastic which is also attached to cone 20. A conductive coil 80 is attached to the former 70 also by a conventional adhesive. By principles of electromagnetics, the current passing through the voice coil and the magnetic field produced by the permanent magnet cause the voice coil to oscillate in accordance with the electrical signal, and drive the diaphragm 30, producing sound.

On the lower portion of the loudspeaker 5 is the magnetic structure containing the permanent magnet 100 comprising a magnet 110, between a top plate 120 and a back plate 130. Both of these plates are constructed from a material capable of being carrying magnetic flux such as steel. Also on the lower half of the loudspeaker 5 is pole piece 140 also constructed from a material capable of carrying magnetic flux such as cast iron. Pole piece 140 is connected to the rest of the loudspeaker structure by means of an adhesive or other means to back plate 130. At the top of the pole piece 140 is a gap between the pole piece 140 and the top plate 120 where the former 70 and magnetic coil 80 are inserted. This structure creates an axial movement of the coil in the magnetic gap.

Figure 2:
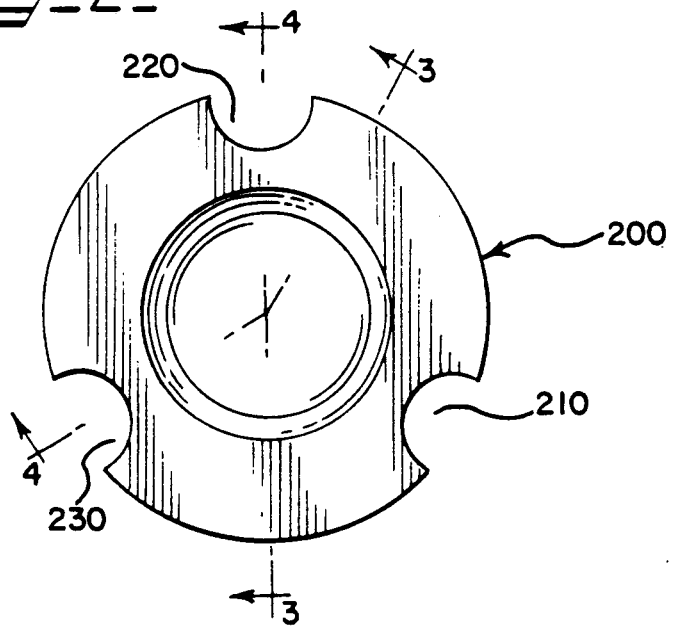
FIG. 2 is a plan view of the magnetic structure forming the invention.
Figure 3:
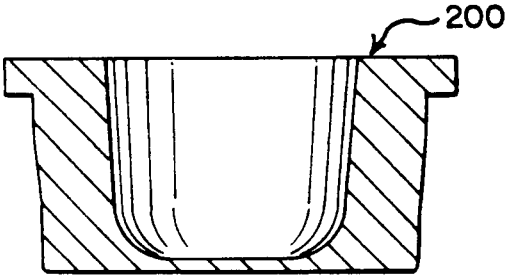
FIG. 3 is a sectional view of the magnetic structure of FIG. 2, taken along section lines 3—3 of FIG. 2.
Figure 4:
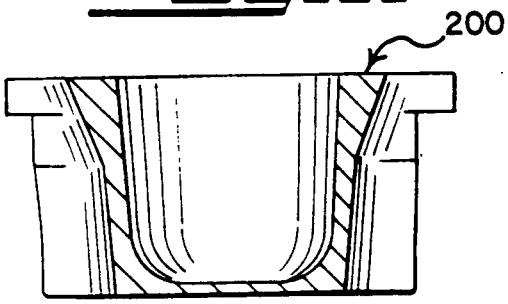
FIG. 4 is another sectional view of the magnetic structure of FIG. 2, taken along section lines 4—4 of FIG. 3.
Figure 5:
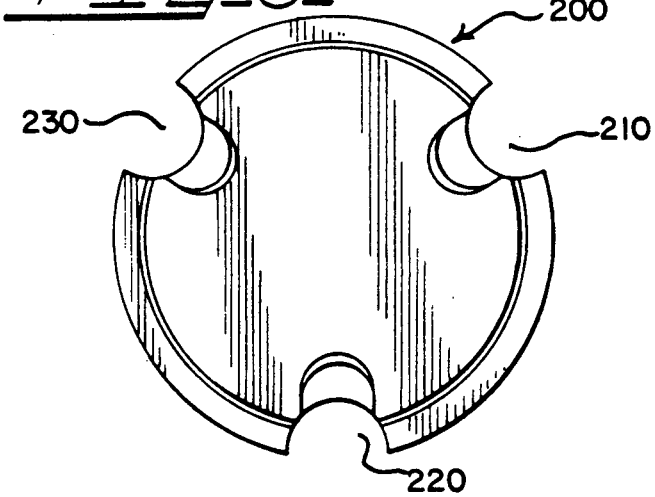
FIG. 5 is a bottom view of the magnetic structure of FIG. 2.

One embodiment of the pole piece structure is depicted in FIGS. 2–5. In FIG. 2, a pole piece 200 corresponding to the pole piece 140 of FIG. 1 having three channels 210, 220 and 230 is shown. Through this structure, portions of the voice coil 80 are cooled by forcing the air displaced by movement of the dome 20 through channels 210, 220 and 230 next to the voice coil 80. The hot air exits the back of the assembly and through a turbulent exchange of air, cooler air is drawn back into the speaker as the dome 20 moves forward. Because of the continuous windings of the voice coil 80 and its good thermal conductivity, the cooling spreads easily to the areas of the coil 80 not directly in the air flow path.

Figure 6:
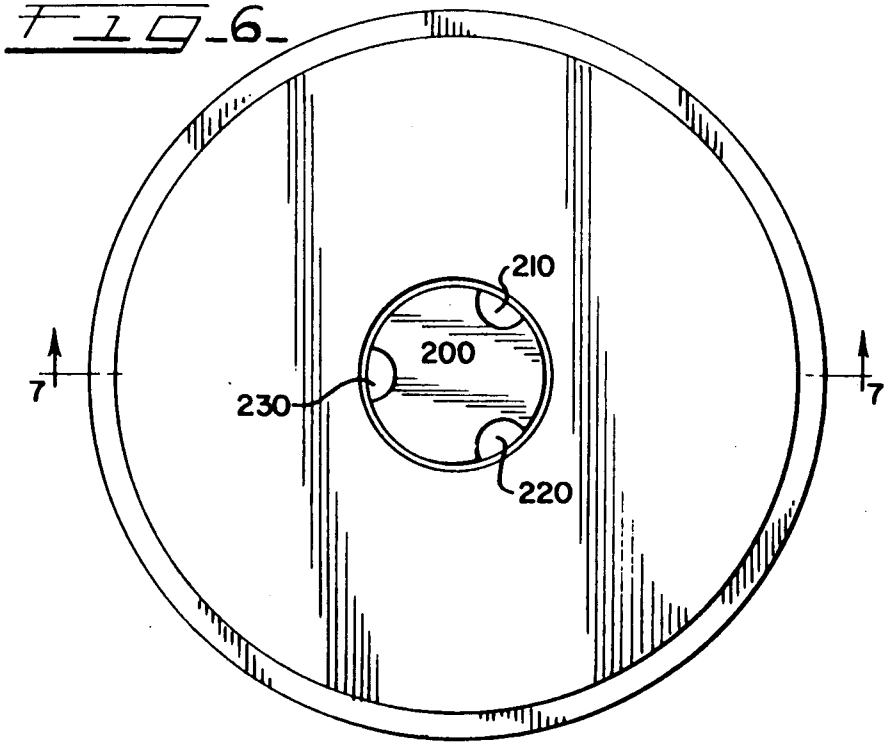
FIG. 6 is a plan view of the magnetic structure forming an embodiment of the invention.

It is important to note that other configurations of the channels than that depicted in FIG. 2 are possible. FIG. 6 shows a variation of the pole piece 200 of FIG. 2 in which the slots 210, 220 and 230 are varied in cross-section along their length. For example, triangular or square shaped channels may be constructed. Preferably at least two channels are used, and more preferably, for reasons of stability of the diaphragm 40, at least three channels are used. Preferably, the number of channels ranges from about 2 to about 50 channels, most preferably from about 3 to about 6 channels. An increase in the number of channels in the magnetic structure or the pole piece results in an increase in the cooling of the voice coils and an increase in power handling. However, there is a limit to the number of channels that may be added without causing sound distortion. As the number of channels is increased, the cross-sectional area of each is decreased, thus causing whistling, by the passage of air through the channels. In a preferred embodiment, the number of channels multiplied by the hole diameter should not be greater than one-fourth of the circumference of the channel and that the total area of the channels should be greater than the area of a circular channel that is one-third of the pole piece diameter.

Figure 7:
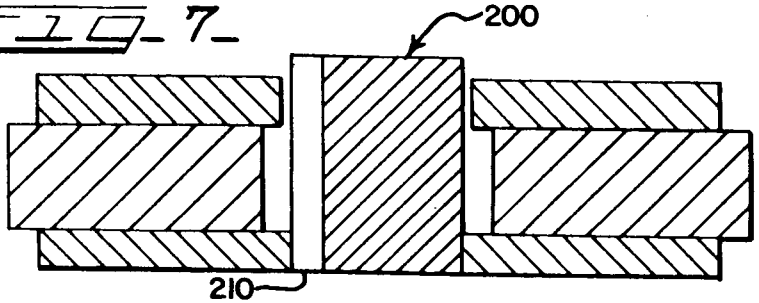
FIG. 7 is a sectional view of the magnetic structure of FIG. 6.

Another embodiment of the invention is depicted in FIGS. 6 and 7 wherein the pole piece 200 may be applied in a magnetic structural configuration of the kind shown in FIG. 7 and the pole piece 200 is solid except for the channels cut out therefrom for passage of air. FIG. 7 is a sectional view taken along section lines 7—7 of FIG. 6.

Figure 8:
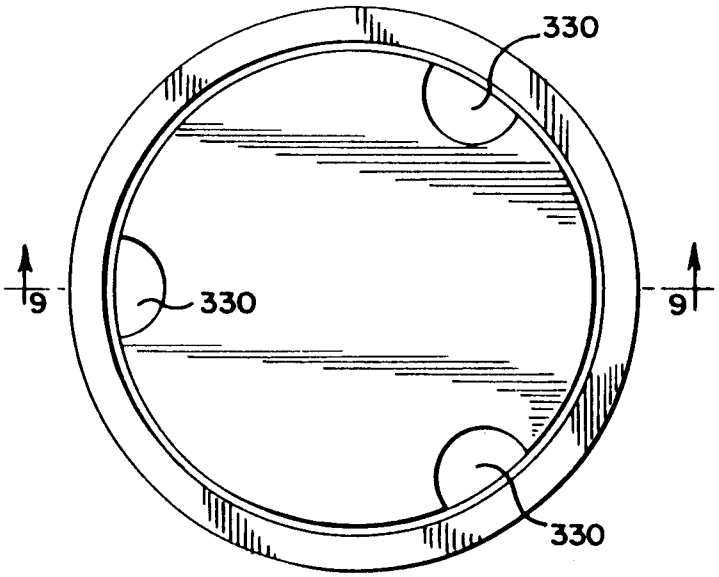
FIG. 8 is a sectional view of the magnetic structure forming another embodiment of the invention.
Figure 9:
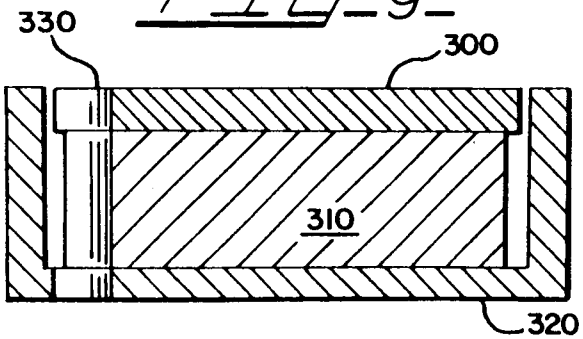
FIG. 9 is a plan view of the magnetic structure of FIG. 8.

Similarly, FIGS. 8 and 9 depict another embodiment of the invention wherein the magnetic structure is shielded and the magnet, top plate and back plate have channels cut therein for passage of air. FIG. 9 is a sectional view taken along section lines 9—9 of FIG. 8. As shown in FIG. 9, a top plate 300 lies adjacent to a magnet 310 which is positioned on top of a back plate 320. Channels 330 are cut in the top plate, the magnet and the back plate where air can pass through the magnetic structure to the exterior of the loudspeaker.

Preferably the channels or passages go through the magnetic structure. A filtering means, such as a fine open mesh is preferably used to filter the cool air before it enters the channels or passages.

While the invention has been described and illustrated in detail, it is to be clearly understood that this is intended by way of example and illustration only and is not to be taken by way of limitation, the spirit and scope of this invention being limited only by the terms of the following claims.

I claim:

1. A self-cooled electrodynamic loudspeaker comprising;

a frame, a diaphragm connected to the frame capable of reciprocal movement, a voice coil connected to the diaphragm responsive to current in the voice coil, and a magnetic structure having an annular magnetic gap at one side thereof for receiving the voice coil, the magnetic structure having a plurality of passages extending from the magnetic gap completely through to the other side of the magnetic structure and wherein each passage is continuous with a corresponding discrete enlargement in the cross-sectional area of the magnetic gap so as to allow air driven by the diaphragm to flow past the voice coil without an excessive pressure drop.

2. A self cooled electrodynamic loudspeaker as claimed in claim 1, wherein the passages are in a semicircular configuration.

3. A self cooled electrodynamic loudspeaker as claimed in claim 1, wherein the passages are in a triangular configuration.

4. A self cooled electrodynamic loudspeaker as claimed in claim 1 wherein the passages are in a square configuration.

5. A self cooled electrodynamic loudspeaker as claimed in claim 1, wherein the diaphragm is connected to the frame by means of a spider and an upper half roll compliance.

6. A self cooled electrodynamic loudspeaker as claimed in claim 5, wherein the spider is made from a phenolic impregnated cloth.

7. A self cooled electrodynamic loudspeaker as claimed in claim 5, wherein the upper half roll compliance is made from a urethane foam.

8. A self cooled electrodynamic loudspeaker as claimed in claim 5, wherein the upper half roll compliance is made from a butyl rubber.

9. A self cooled electrodynamic loudspeaker as claimed in claim 5, wherein the upper half roll compliance is made from a phenolic impregnated cloth.

10. A self-cooled electrodynamic loudspeaker as set forth in claim 1 wherein the magnetic structure comprises a pole piece and a magnet.

11. A self-cooled electrodynamic loudspeaker as set forth in claim 10 wherein the magnetic structure further comprises a top plate and a back plate.

12. A self-cooled electrodynamic loudspeaker as set forth in claim 11 wherein the annular gap for receiving the voice coil is between the pole piece and the top plate.

13. A self-cooled electrodynamic loudspeaker as set forth in claim 12 wherein the passages are cut out from the pole piece.

14. A self-cooled electrodynamic loudspeaker as set forth in claim 12 wherein the passages are cut from the top and bottom plates.

15. A self-cooled electrodynamic loudspeaker having a frame, a diaphragm connected to the frame capable of reciprocal movement, a voice coil connected to the diaphragm, a magnetic structure composed of a magnet and a pole piece whereby a magnetic flux is created across a narrow magnetic gap formed by a top plate and the pole piece, thus causing the voice coil and hence the diaphragm to move as current passes through the voice coil, wherein the improvement consists of at least two channels adjacent to the voice coil for the passage of air driven by movement of the diaphragm in response to current passing through the voice coil and wherein each channel is continuous with a corresponding discrete enlargement in the cross-sectional area of the magnetic gap to allow air driven by the diaphragm to flow past the voice coil without an excessive pressure drop and further wherein each channel extends from the magnetic gap to an opening allowing the air to be exhausted away from the magnetic gap.

* * * * *